US006935848B2

(12) United States Patent
Marshal et al.

(10) Patent No.: US 6,935,848 B2
(45) Date of Patent: Aug. 30, 2005

(54) DISCHARGE MUFFLER PLACEMENT IN A COMPRESSOR

(75) Inventors: Steve Edwin Marshal, Abingdon, VA (US); David Rex Gilliam, Bristol, VA (US); David Turner Monk, Bristol, VA (US); Benjamin Alan Majerus, Bristol, VA (US)

(73) Assignee: Bristol Compressors, Inc., Bristol, VA (US)

( * ) Notice: Subject to any disclaimer, the term of this patent is extended or adjusted under 35 U.S.C. 154(b) by 95 days.

(21) Appl. No.: 10/441,306

(22) Filed: May 19, 2003

(65) Prior Publication Data

US 2004/0234387 A1 Nov. 25, 2004

(51) Int. Cl.[7] ..... F04B 39/00; F04B 17/00

(52) U.S. Cl. ..... 417/312; 417/902; 181/403

(58) Field of Search ..... 417/312, 313, 417/540, 902; 181/403, 250, 273, 266

(56) References Cited

U.S. PATENT DOCUMENTS

| | | | | |
|---|---|---|---|---|
| 4,033,707 A | | 7/1977 | Stutzman | |
| 4,185,715 A | | 1/1980 | Reu Boiu | |
| 4,239,461 A | | 12/1980 | Elson | |
| 4,313,715 A | | 2/1982 | Richardson, Jr. | |
| 4,330,239 A | | 5/1982 | Gannaway | |
| 4,360,321 A | | 11/1982 | Copp, Jr. et al. | |
| 4,370,099 A | | 1/1983 | Gannaway | |
| 4,396,360 A | | 8/1983 | Elson | |
| 4,401,418 A | | 8/1983 | Fritchman | |
| 4,406,590 A | | 9/1983 | Kessler | |
| 4,406,593 A | | 9/1983 | Kessler | |
| 4,518,323 A | | 5/1985 | Elson et al. | |
| 4,559,686 A | | 12/1985 | Kessler | |
| 4,573,880 A | * | 3/1986 | Hirano et al. | 417/312 |
| 4,576,555 A | | 3/1986 | Ashenfelter | |
| 4,591,318 A | | 5/1986 | Elson | |
| 4,623,304 A | * | 11/1986 | Chikada et al. | 417/312 |
| 4,781,545 A | | 11/1988 | Yokomizo et al. | |
| 4,929,157 A | | 5/1990 | Steele et al. | |
| 5,101,931 A | | 4/1992 | Blass et al. | |

(Continued)

FOREIGN PATENT DOCUMENTS

| | | |
|---|---|---|
| EP | 0 551 713 A1 | 7/1993 |
| EP | 1 033 492 A1 | 9/2000 |
| GB | 2 039 613 A | 8/1980 |
| JP | 3-9089 | 1/1991 |

*Primary Examiner*—Cheryl Tyler
*Assistant Examiner*—Timothy P. Solak
(74) *Attorney, Agent, or Firm*—McNees Wallace & Nurick LLC

(57) ABSTRACT

A muffler system for a compressor includes an expansion chamber muffler for attenuating sound pressure pulses and an acoustic muffler for filtering high-frequency pressure pulsations. The acoustic muffler is connected inline along the discharge side of the compressor between the discharge port of the cylinder head and a discharge tube in fluid communication with the outlet port of the compressor housing. A conduit is in fluid communication between the outlet port of the compressor housing and the condenser to supply the flow of refrigerant therebetween. Interposed adjacent the compressor housing, but exterior to the compressor housing is an expansion chamber muffler in fluid communication with the conduit for further attenuating pressure pulses generated by operation of the compressor.

20 Claims, 6 Drawing Sheets

U.S. PATENT DOCUMENTS 5,112,198 A 5/1992 Skinner
5,129,793 A 7/1992 Blass et al.
5,194,717 A 3/1993 Cowen et al.
5,205,719 A 4/1993 Childs et al.
5,224,840 A 7/1993 Dreiman et al.
5,252,036 A 10/1993 Bunch et al.
5,326,231 A 7/1994 Pandeya et al.
5,330,329 A 7/1994 Clark
5,333,460 A 8/1994 Lewis et al.
5,341,654 A 8/1994 Hewette et al.
5,427,506 A 6/1995 Fry et al.
5,503,542 A 4/1996 Grassbaugh et al.
5,556,265 A 9/1996 Michiyuki et al.
5,596,879 A * 1/1997 Burkhart et al. ..... 62/296
5,635,687 A * 6/1997 Biscaldi ..... 181/272
5,800,133 A 9/1998 Ikeda et al.
5,899,670 A 5/1999 Ikeda et al.
6,102,160 A 8/2000 Cornelius
6,149,397 A 11/2000 Mizutani et al.
6,152,703 A 11/2000 Yoshimura et al.
6,213,732 B1 4/2001 Fujio
6,296,457 B1 * 10/2001 Shintoku et al. ..... 417/312
6,305,919 B1 10/2001 Staton et al.
6,332,510 B1 12/2001 Frederiksen et al.
6,390,788 B1 5/2002 Tack
6,488,482 B1 12/2002 Yannascoli et al.
6,558,137 B2 * 5/2003 Tomell et al. ..... 417/312
2002/0098093 A1 7/2002 Tomell et al.

* cited by examiner

DISCHARGE MUFFLER PLACEMENT IN A COMPRESSOR

This Application is related to Application Ser. No. 10/440,763, filed contemporaneously with this Application on May 19, 2003, entitled "DISCHARGE MUFFLER HAVING AN INTERNAL PRESSURE RELIEF VALVE" assigned to the assignee of the present invention and which is incorporated herein by reference.

FIELD OF THE INVENTION

The present invention is directed to a muffler system for use with a compressor, and more specifically to a muffler system having an internal muffler and an external muffler for use with the high-pressure discharge side of a compressor used in refrigeration, cooling and heating systems.

BACKGROUND OF THE INVENTION

Compressors are one of several components in cooling and heating systems. They are an important component as the compressor is used to compress refrigerant gas used in the system, raising the pressure and the temperature of the gas. The compressor is typically used in combination with a condenser, expansion valves, an evaporator and blowers to heat or cool a space. Depending on the direction of the refrigerant flow upon exiting the compressor, the system can be used to remove heat from a preselected space or provide heat to a preselected space.

The compressor itself typically is a hermetically sealed device that has an intake port and a discharge port. The hermetically sealed device typically is a metallic shell that houses an electric motor and a mechanical means, such as pistons or other mechanical portion, for compressing gas. For most compressor designs, the gas cavity enclosed by the housing serves as a reservoir of low-pressure gas to be drawn into the mechanical section of the compressor. The electric motor is connected to a power source that provides line power for operation. The motor in turn drives the means for compressing gas. Compressors are typically categorized by the means used to compress the gas. For example, compressors using a scroll compression device to compress refrigerant gas are referred to as scroll compressors; compressors using a piston device to compress the refrigerant gas are referred to as reciprocating compressors; compressors using rotating screw devices to compress a refrigerant gas are known as screw compressors. While there are differences among the compressors as to how refrigerant gas is compressed, the basic principles of operation as set forth above are common among the compressors, i.e., gas is drawn in through the gas intake when the motor is energized, the gas is compressed in the mechanical portion of the compressor and the highly compressed gas is discharged through an outlet port.

While different compressor designs may result in different noise generation mechanisms and overall different noise profiles, there are common sources of noise for the various types of compressors. One common source of noise originates in the exhaust gas at the discharge where the noise takes the form of a pressure pulsation. Pressure pulsation in the exhaust gas typically generates discrete narrowband tones at the harmonics of the operating speed. The pulsation propagates from the compressor discharge mechanism downstream in the refrigerant gas. The pressure pulsation can transmit noise through the compressor housing at the point of discharge tube penetration, or can propagate further downstream and induce noise upon contacting other components of the refrigeration system. As can be seen, this sound is particularly undesirable when the system is located within, adjacent to or near a living area or a work area.

Various mufflers have been attempted to eliminate, reduce or otherwise attenuate pressure pulsation and compressor noise. For piston-driven compressors, mufflers are typically positioned inside the compressor housing on the discharge side of the cylinder head, also referred to as a discharge head. While a muffler having an expansion chamber located adjacent to the discharge head can prevent pressure pulsation from propagating downstream, it has been found that placement of an expansion chamber muffler adjacent the discharge head reduces operating efficiency of the compressor, while also increasing the overall size of the compressor.

What is needed is a compressor muffler system that sufficiently attenuates pressure pulsations generated by compressor operations without adversely affecting compressor operating efficiency.

SUMMARY OF THE INVENTION

The present invention relates to a muffler system for a compressor having a compressor shell and a compressing device with a gas discharge port. An acoustic muffler is disposed within the compressor shell and in fluid communication with the gas discharge port upon installation. An expansion muffler is disposed exterior to the compressor shell at a predetermined distance from the gas discharge port upon installation. An exhaust system connects the acoustic muffler and the expansion chamber muffler.

The present invention further relates to a compressor system including a housing having an exhaust port. A compression means is provided for compressing a refrigerant fluid, the compression means being disposed within the housing. The compression means has a discharge port for exhausting compressed refrigerant fluid from the compression means. An acoustic muffler is disposed within the housing and in fluid communication with the discharge port, and the acoustic muffler is in fluid communication with the exhaust port. An expansion muffler is disposed exterior the housing a predetermined distance from the exhaust port and in fluid communication with the exhaust port.

An advantage of the present invention is the inclusion of an expansion chamber muffler exterior of the compressor housing for attenuating pressure pulses from reaching the condenser, reducing the overall size of the compressor housing, while not adversely affecting compressor operating efficiency.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
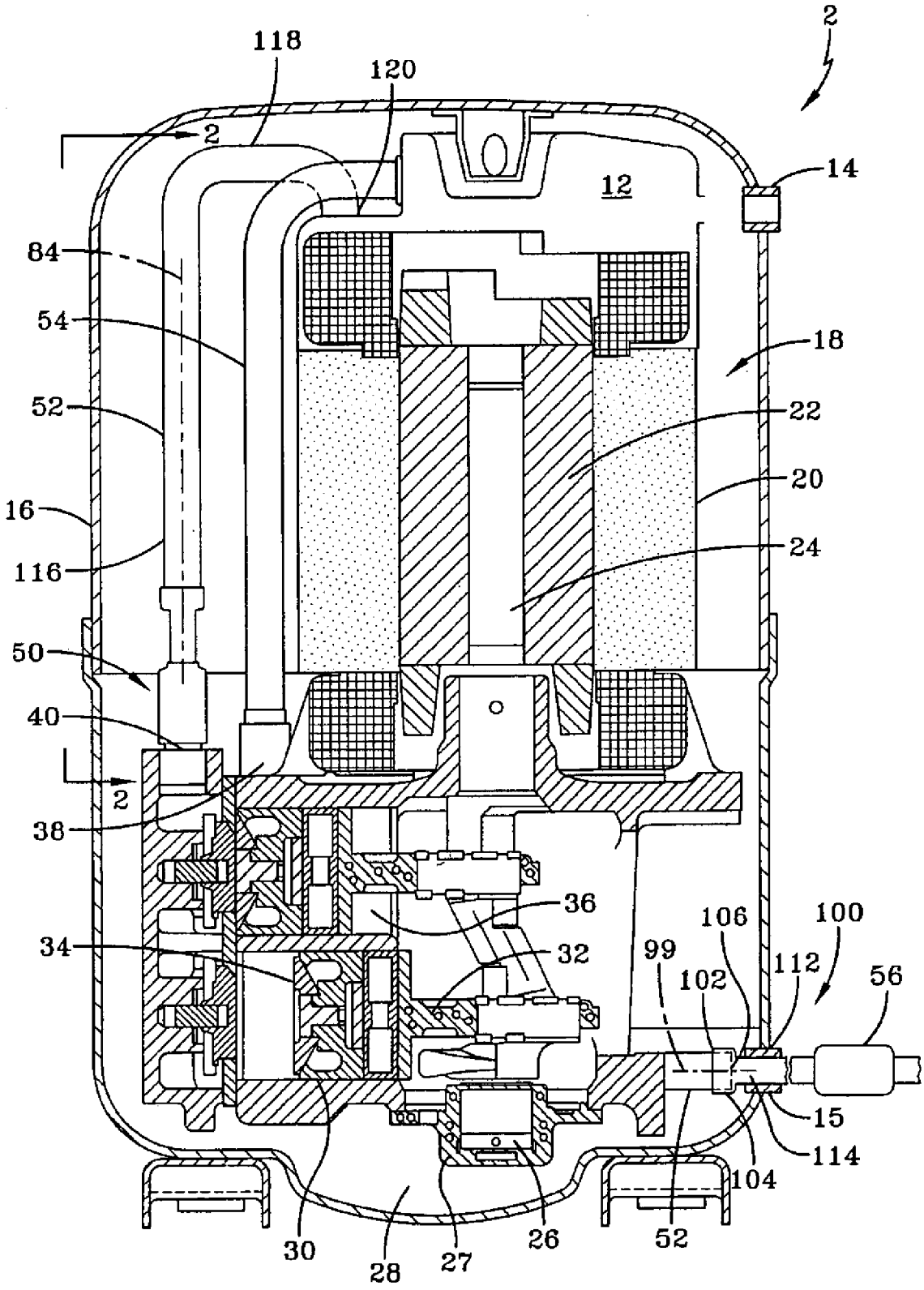
FIG. 1 is a cross-section of a refrigerant compressor that incorporates the muffler system of the present invention.

One embodiment of a compressor that incorporates the muffler system of the present invention is depicted in FIG. 1. The compressor 2 is connected to a conventional refrigeration or heating, ventilation and air conditioning (HVAC) system (not shown), such as may be found in a refrigerator, home or automobile, having a condenser, expansion device and evaporator in fluid communication. Compressor 2 is preferably a reciprocating compressor connected to an evaporator (not shown) by a suction line that enters the suction port 14 of compressor 2. Suction port 14 is in fluid communication with suction plenum 12. Refrigerant gas from the evaporator enters the low pressure side of compressor 2 through suction port 14 and then flows to the suction plenum 12 before being compressed.

Compressor 2 includes an electrical motor 18. A standard induction motor having a stator 20 and a rotor 22 is shown. However any other electrical motor may be used. A shaft assembly, 24 extends through rotor 22. The bottom end 26 of shaft assembly 24 in this compressor 2 extends into a lubrication sump 28 and includes a series of apertures 27. Connected to shaft assembly 24 below the motor is at least one piston assembly 30. Compressor 2 of FIG. 1 depicts two piston assemblies. A connecting rod 32 is connected to a piston head 34 which moves back and forth within cylinder 36. A cylinder head includes a gas inlet port 38 and a gas discharge port 40. Associated with these ports 38, 40 are respective suction valves and discharge valves (not shown) assembled in a manner well known in the art. Gas inlet port 38 is connected to an intake tube 54 which is in fluid communication with suction plenum 12.

Motor 18 is activated by a signal in response to a predetermined condition, for example, an electrical signal from a thermostat when a preset temperature is reached. Electricity is supplied to stator 20, and the windings in the stator 20 cause rotor 22 to rotate. Rotation of rotor 22 causes the shaft assembly 24 to turn. In the compressor shown, oil in the sump 28 is drawn through apertures 27 in bottom end 26 of shaft 24 and moved upward through and along shaft 24 to lubricate the moving parts of compressor 2.

Rotation of rotor 22 also causes reciprocating motion of piston assembly 30. As the assembly moves to an intake position, piston head 34 moves away from gas inlet port 38, the suction valve opens and refrigerant fluid is introduced into an expanding cylinder 36 volume. This gas is pulled from suction plenum 12 within compressor housing 16. This gas is pulled into intake tube 54 to gas inlet port 38 where it passes through the suction valve and is introduced into cylinder 36. When piston assembly 30 reaches a first end (or top) of its stroke, shown by movement of piston head 34 to the right side of cylinder 36 of FIG. 1, the suction valve closes. The piston head 34 then compresses the refrigerant gas by reducing the cylinder 36 volume. When piston assembly 30 moves to a second end (or bottom) of its stroke, shown by movement of piston head 34 to the left side of cylinder 36 of FIG. 1, a discharge valve is opened and the highly compressed refrigerant gas is expelled through gas discharge port 40. The highly compressed refrigerant gas flows from the gas discharge port 40 into an acoustic muffler 50 then through an exhaust or discharge tube 52, exiting the compressor housing 16 into a conduit connected to a condenser. An expansion chamber muffler 56 positioned outside the compressor housing 16 is connected in fluid communication with the conduit between the compressor 2 and the condenser adjacent the compressor housing 16. This comprises one cycle of the piston assembly 30.

The placement of muffler 56 physically outside compressor housing 16 and at any of a number of specific distances along the conduit connecting compressor housing 16 and the condenser is crucial in reducing the pressure pulsation at the first harmonic of the rotation frequency of the compressor motor. That is, muffler 56 may be placed at any of a number of specific distances from the gas discharge port 40 as measured from the sum of the travel lengths of muffler 50, discharge tube 52 and the conduit between the compressor housing 16 and muffler 56. Further, locating muffler 56 outside compressor housing 16, not only permits a reduction in size of the compressor housing 16, but enhances the effectiveness of muffler 56 without adversely affecting the efficiency of the compressor as will be discussed in further detail below. Acoustic muffler 50 additionally filters higher frequency pressure pulsations that tend to radiate directly from compressor housing 16 as unwanted noise. Acoustic muffler 50 preferably includes an internal pressure relief valve (IPRV), or pressure relief member 60 connected to a resonator volume 82 (FIG. 4).

Figure 2:
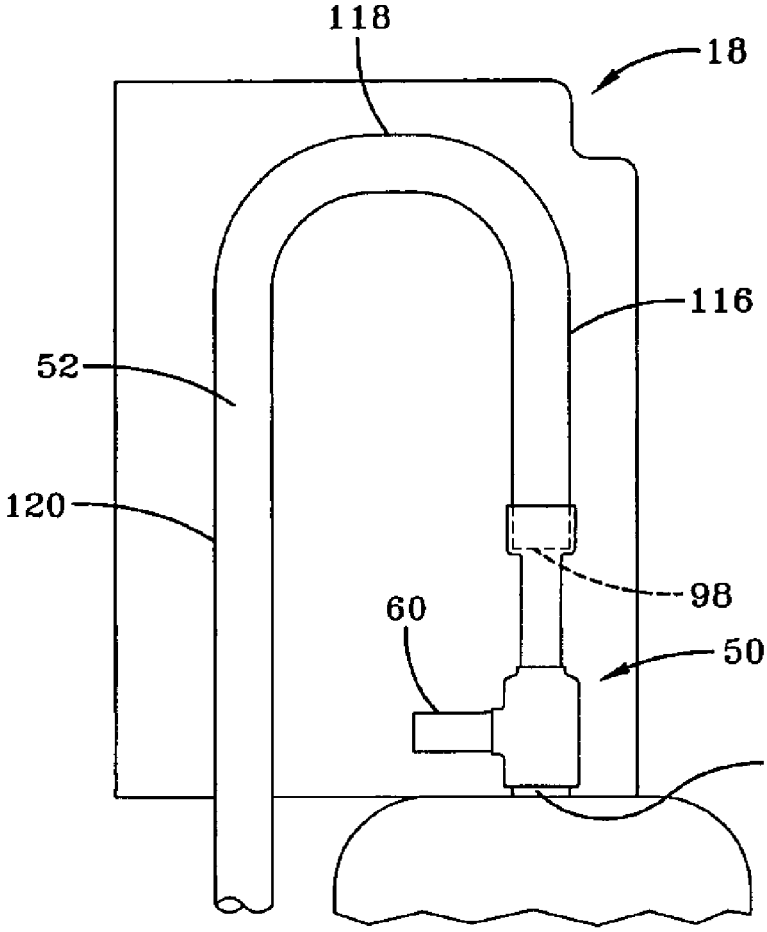
FIG. 2 is a partial elevation view of the acoustic muffler discharge tube of the present invention taken along line II—II from FIG. 1.
Figure 3:
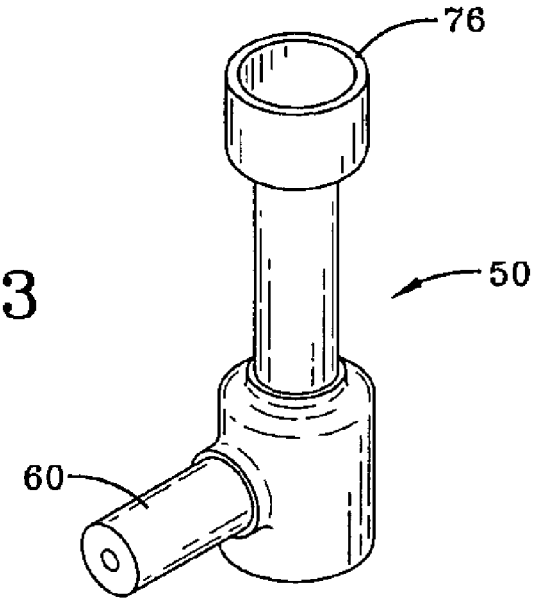
FIG. 3 is a perspective view of a muffler of the present invention.
Figure 4:
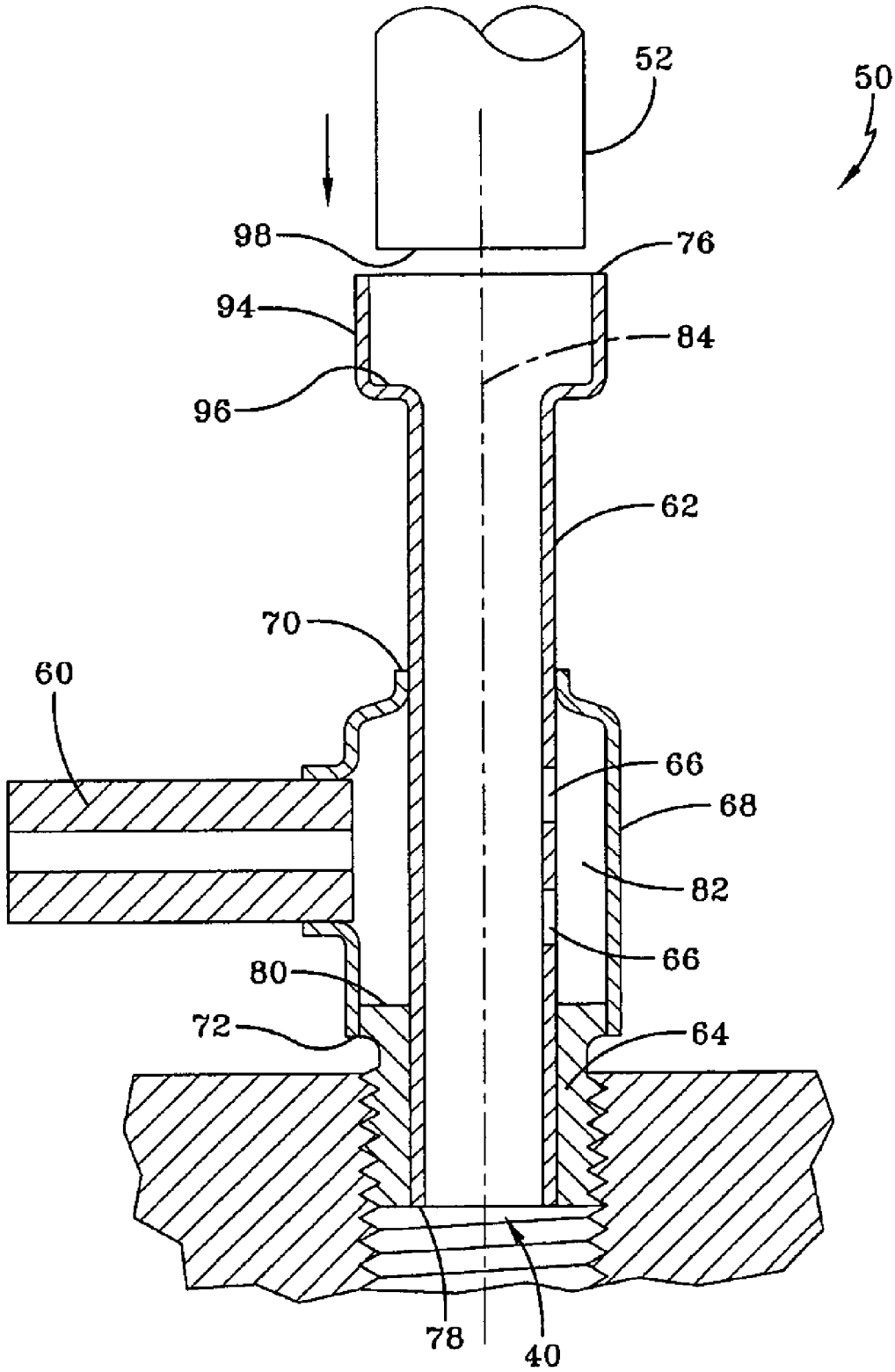
FIG. 4 is a cross-section of the muffler being joined to the discharge tube of the present invention.

Referring to FIGS. 2–4, acoustic muffler 50 preferably utilizes a side-branch resonator volume 82 to filter pressure pulsations that generate noise at the discharge tube 52—compressor housing 16 penetration. Acoustic muffler 50 includes a tube 62 having opposed ends 76, 78. A threaded member 64 having a lip 80 at one end is positioned over end 78 of tube 62 for threadedly engaging the discharge head to maintain tube 62 in fluid communication with gas discharge port 40. Preferably, the end 78 of tube 62 and the end of threaded member 64 opposite lip 80 are substantially coincident to ensure the parts are sufficiently engaged therebetween. A housing 68 alternative includes opposed openings 70, 72 which permits opening 70 of housing 68 to be positioned over end 78 of tube 62 until opening 72 of housing 68 sufficiently contacts lip 80. Methods of securing tube 62, housing 68 and threaded member 64 in position to each other such as spot welding, soldering, brazing, or by press-fit are well known in the art. Housing 68 is substantially cylindrical in profile and defines a resonator volume 82 between tube 62 and housing 68. Tube 62 and housing 68 are maintained in fluid communication by a pair of preferably axially aligned resonator throats 66 formed in tube 62. The flow area and distance between the resonator throats 66, as well as the size of the volume resonator 82 are specified such to 'tune' the side-branch resonator muffler to the pulsation frequencies most likely to excite noise at the discharge tube 52—compressor housing 16 penetration. Resonator volume 82 displaces significantly less volume than typically used mufflers which employ an expansion chamber. Although not necessarily drawn to scale in FIG. 4, between openings 70, 72, resonator volume 82 displaces a comparable volume as compared to tube 62. By virtue of both this lack of pronounced volumetric increase of resonator volume 82 that is adjacent the discharge port 40 and controlling the specific distance from the discharge head to the expansion chamber, compressor efficiency is maintained. Additionally, the small size of housing 68 of muffler 50 permits reduction in size of the compressor housing.

One end of discharge tube 52 is connected to muffler 50. The other end of discharge tube 52 is connected to the discharge outlet 15 of compressor 2. While a preferred embodiment of discharge tube 52 is of unitary construction, as previously discussed, if desired, discharge tube 52 may be segmented, such as to insert a discharge-side component such as an IPRV 60. A portion of the discharge tube 52 adjacent muffler 50 preferably has a cane or inverted "J" shape, but can have any suitable shape. The shape of discharge tube 52 is primarily driven by the location and attitude of the two interface locations within the compressor housing 16 while maintaining sufficient spacing from compressor components. Thus, the path of the unitary discharge 52 tube typically follows a path adjacent the compressor housing 16, preferably including from end 98, which a substantially straight portion 116 which extends into a substantially curved portion 118 and similarly extends into a remaining portion 120 that terminates at end 106. Referring back to FIGS. 1, 2 and 4, both tube 62 of muffler 50 and a portion of discharge tube 52 share a coincident axis 84. The segment or portion of discharge tube 52 that extends along axis 84 is of an extended length which more evenly distributes prestresses along the collective axial length of tube 52. Additionally, the joint formed between discharge tube 52 and tube 62 of muffler 50 is also coincident with axis 84. In one embodiment, tube 62 of muffler 50 has an enlarged diameter portion 94 that extends into a shoulder 96 formed therein that is coincident with axis 84. To establish the joint between tube 62 of muffler 50 and discharge tube 52, an end 98 of exhaust tube 52 is directed inside the enlarged diameter portion 94 of tube 62 past end 76 to the extent required to form the joint, up to "bottoming out" at the shoulder 96.

Discharge tube 52 connects in a similar way to discharge outlet 15. Discharge outlet 15 includes a fitting 100 that extends through an aperture 112 in the compressor housing 16. The fitting 100 is provided with a secure joint between itself and the compressor housing 16 that is both fluid tight and rigid, both to prevent the leakage of refrigerant through aperture 112 and avoid unnecessary flexure to the subsequent joints formed between both the fitting 100 and the discharge tube 52 inside the compressor housing 16 and between the conduit and the fitting 100 located outside the compressor housing 16. A fitting portion 114 of fitting 100 extends inside the compressor housing 16 which axially aligns along axis 99 with end 106 of tube 52. The portion of fitting portion 114 that is inside compressor housing 16 includes an end 102 having an enlarged diameter portion 104. To establish a joint between the discharge tube 52 and fitting portion 114, the end 106 of discharge tube 52 is directed past end 102 of fitting portion 114 along axis 99 into the enlarged diameter portion 104 until a joint is formed. The joint may be secured by soldering or other appropriate bonding method. Preferably, the joints for each end 98, 106 of discharge tube 52 is established prior to securing the joints. By virtue of the this variable, coincident insertion distance along enlarged diameter portion 94 between discharge tube 52 and tube 62 of muffler 50 and between discharge tube 52 and fitting portion 114, prestresses in the discharge tube 52 caused by non-alignment installation conditions may be further reduced, thereby improving the structural integrity of the compressor.

Figure 7:
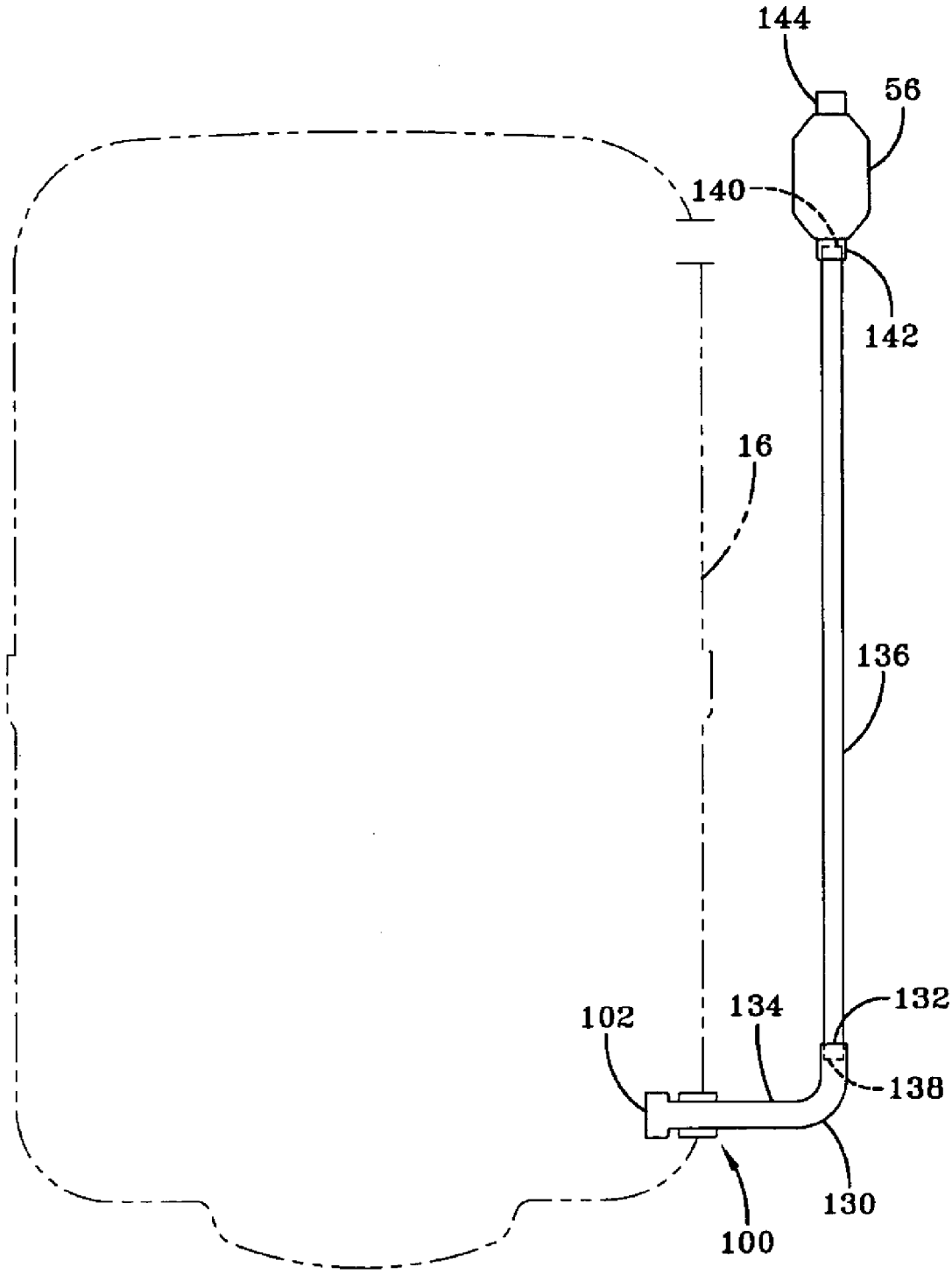
FIG. 7 is an elevation view of an embodiment of the present invention showing the position of an external muffler.
Figure 8:
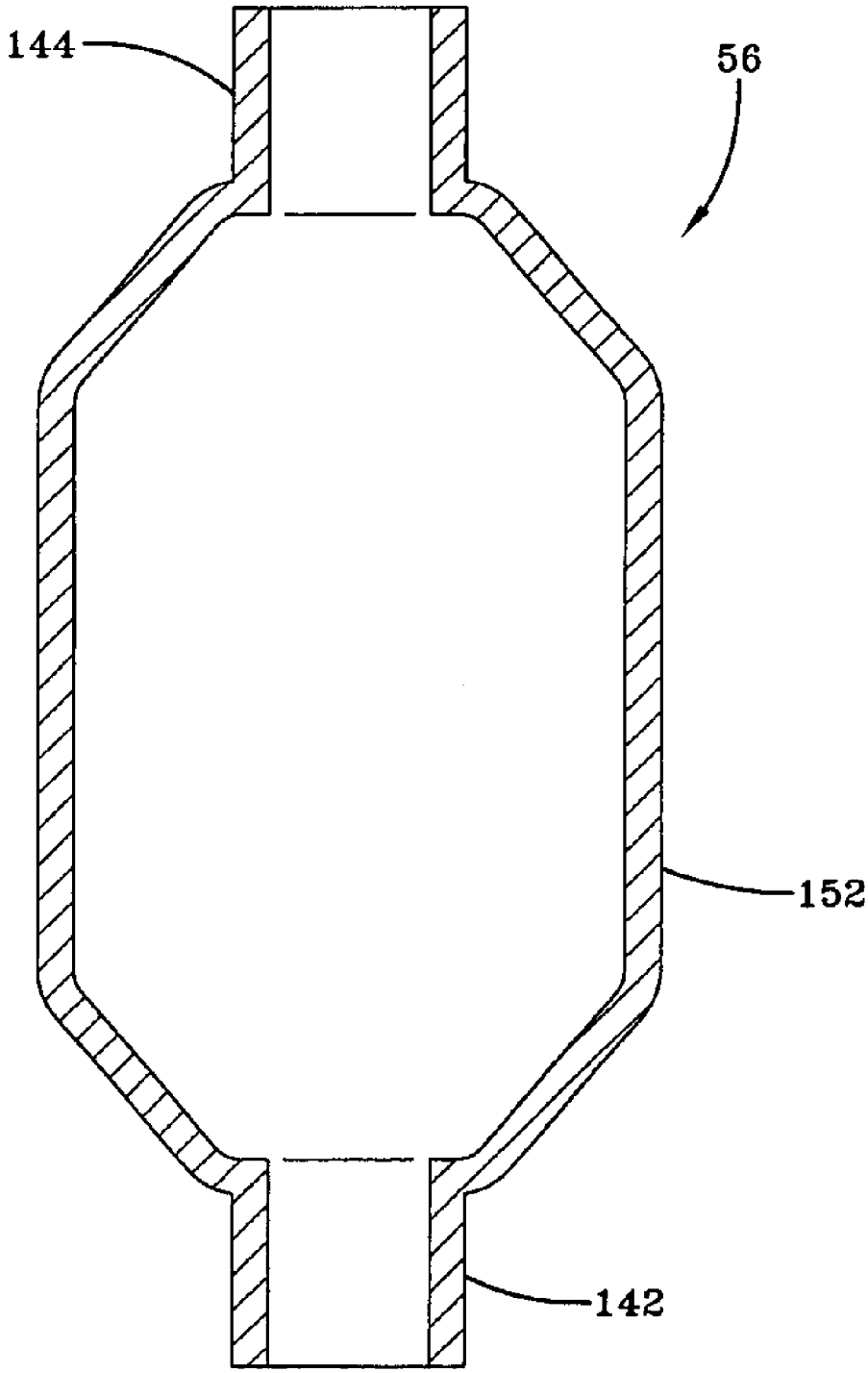
FIG. 8 is a cross section of the external muffler of the present invention.

Referring to FIGS. 7, 8, fitting 100 extends outside compressor housing 16 into an extension 134 which further extends into a bend 130, preferably a right angle, that terminates at an upturned end 132. Alternately, fitting 100 could terminate immediately outside of compressor housing 16, if desired. A substantially straight conduit 136 has an end 138 that inserts inside of end 132 of fitting 100 for connection therewith. Conduit 136 extends substantially parallel to the compressor housing 16 in a substantially vertical direction by virtue of the right angle connection with end 132, terminating at end 140 which, in one embodiment, is adjacent the top of the compressor housing 16. Alternately, conduit 136 could be curved in shape and could extend in any direction or attitude with respect to fitting 100. The second muffler member 56 is connected at inlet end 142 with end 140 of conduit 136 and has an opposed exhaust end 144 for connection with a conduit connecting with a condenser (not shown). Fitting 100, conduit 136 and muffler 56 are in continuous fluid communication therebetween so that refrigerant fluid exhausting from compressor housing 16 sequentially flows through fitting 100 and conduit 136 before reaching muffler 56.

Figure 5:
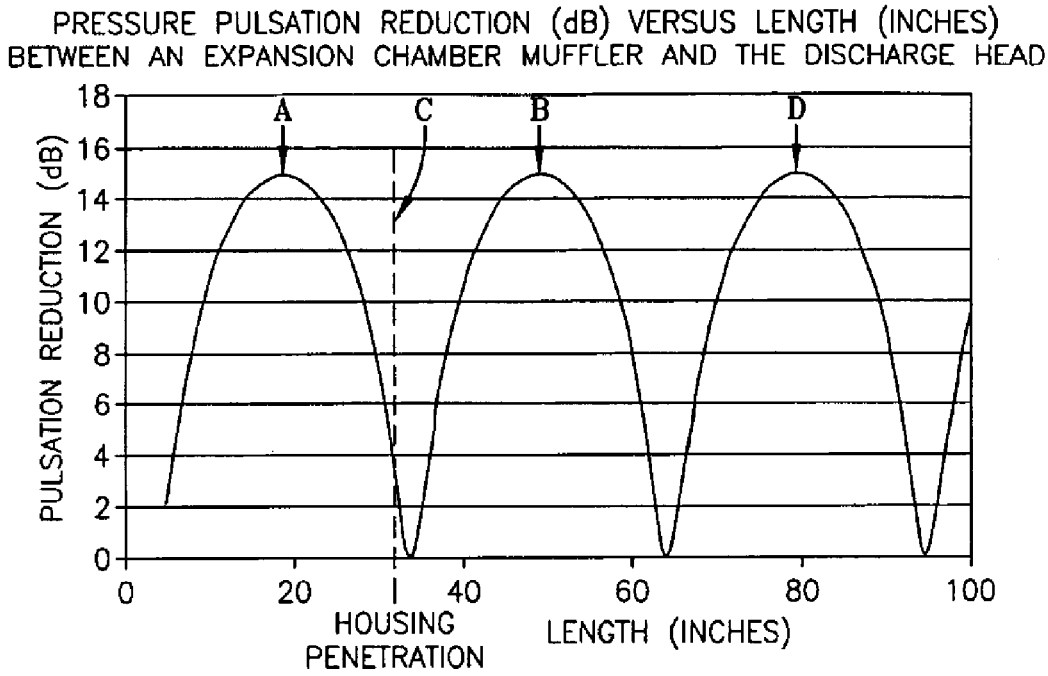
FIG. 5 is a graph illustrating pressure pulsation reduction versus expansion chamber location from the discharge head.

Muffler 56 attenuates pressure pulses generated by operation of the compressor. Muffler 56 is provided with the inlet end 142 and the exhaust end 144 on opposed ends of muffler 56. A preferably enlarged diameter housing 152 is interposed between inlet end 142 and exhaust end 144. The gas volume enclosed by housing 152 serves to filter pressure pulsations propagating in conduit 136. The ability for muffler 56 to filter pressure pulsations is extremely sensitive to the total distance between the discharge head and muffler 56. In fact, the muffler 56 can be located along the discharge path at numerous positions to filter a specific troublesome frequency. FIG. 5 provides a design guide to position the muffler such to achieve maximum reduction attenuation of the pulsation frequency, often the most troublesome frequency in a refrigerant compressor as will be discussed in additional detail below.

A compressor system using the novel combination of the acoustic muffler 50 mounted internally within the compressor housing 16 and muffler 56 mounted adjacent but external to the compressor housing has been tested. Further referring to FIG. 5, sound attenuation is illustrated as a function of distance from the discharge head of the compressor for a particular frequency and refrigerant. It is shown that significant sound attenuation can be achieved with an expansion chamber muffler positioned approximately 15–20 inches from the discharge head, which is identified as region "A" on the attenuation curve. The distance from the discharge head to the expansion chamber muffler is related to the travel distance of refrigerant between the discharge head and the expansion chamber muffler. Region "A" is inside the compressor housing which is identified by the vertical dotted line that is approximately 32 inches from the discharge head and additionally identified as "C". However, significant efficiency losses of at least two percent are attributable with the muffler being located within the compressor housing adjacent the discharge head as compared to being located further downstream. Also, the muffler requires significant volume which is not always available inside the housing. Note, however, that further along the curve, approximately 45–50 inches from the discharge head, identified as region "B", the sound attenuation is substantially identical to the level shown in region "A". Similarly, region "D", which is located approximately 77–82 inches from the discharge head, provides substantially identical sound attenuation to the level shown in region "A". Region "B" is located approximately 15–20 inches from the position of the housing penetration and region "D" is located approximately 45–50 inches from the housing penetration. For purposes herein, the position of the compressor housing discharge port and the housing penetration (region "C") are substantially the same. In other words, by connecting the expansion muffler to the discharge port by a conduit of less than two feet in length or approximately four feet in length, the compressor operates as quietly and more efficiently while gaining additional room within the compressor housing or permitting the volume of the compressor housing to be reduced and still achieving the same performance.

It is also noteworthy that the peak attenuation levels, at least for the particular plotted frequency in FIG. 5, is not especially "pointed". That is, at Region "B", although maximum attenuation of approximately 15 dB may occur at 48 inches from the discharge head, due to the relative "flatness" of the curve along its peak, attenuation levels of approximately 14.5–15 dB may be achieved with a range of approximately 45–51 inches from the discharge head. Thus, by locating the expansion muffler chamber within a reasonably broad distance range from the discharge head, without requiring precise measurements, it appears possible to achieve substantially maximum noise attenuation levels for the expansion muffler.

In addition to reduced compressor housing size and efficiency gains as previously discussed, by virtue of muffler 56 being used outside the compressor housing, the user has the opportunity to easily replace muffler 56, if desired. Typically, as compressor capacity increases, so does the amplitude of the pressure pulsations associated with its operation. Thus, different mufflers may be desirable for use with compressors having different operating capacities, although identical mufflers may be selected for use with compressors having different operating capacities to reduce inventory. With the present invention, if the user need only replace an existing muffler with another configured to attenuate the increased amplitudes, since the existing muffler was already positioned within the range of lengths corresponding to substantially maximum attenuation levels.

Figure 6:
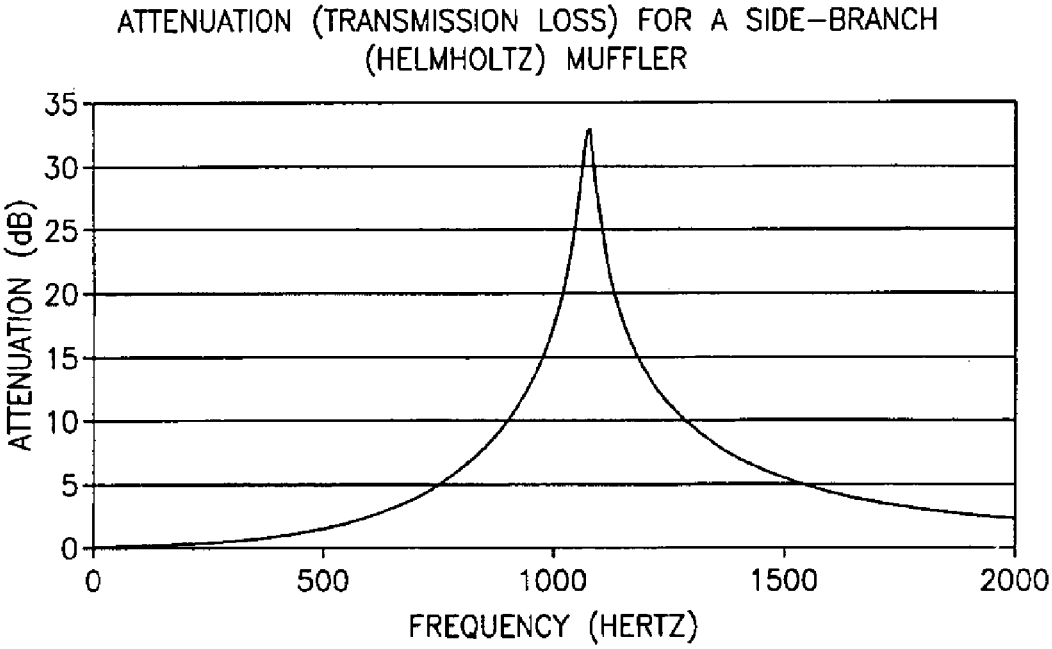
FIG. 6 is a graph illustrating pressure fluctuation attenuation for a tuned side-branch muffler.

While the expansion muffler 56 functions to filter pressure pulses from propagating downstream that generate noise upon contacting valves or condenser coils, a muffler is still needed inside the compressor housing to filter the pressure pulses that may transmit noise to the housing at the point of penetration. Referring to FIG. 6, the sound attenuating performance of the acoustic muffler is illustrated. As shown, peak attenuation occurs at approximately 1,000 Hz corresponding to an attenuation of approximately 32 dB which is sufficient to effectively address vibration issues within the compressor housing which are centered around this frequency range.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the appended claims.

What is claimed is:

1. A muffler system for a compressor having a compressor shell and a compressing device with a gas discharge port, the muffler system comprising:

a resonator type muffler disposed within the compressor shell and in fluid communication with and connected to the gas discharge port upon installation;

an expansion muffler disposed exterior to the compressor shell at a predetermined distance from the gas discharge port upon installation; and an exhaust system connecting the resonator type muffler and the expansion muffler, the predetermined distance of the expansion muffler being independent of the spacing along the exhaust system between the resonator type muffler and the expansion muffler.

2. The muffler system of claim 1 wherein the predetermined distance between the expansion muffler and the gas discharge port substantially corresponds to an upper attenuation level of noise reduction achievable by the expansion muffler.

3. The muffler system of claim 2 wherein the predetermined distance substantially corresponds to the second occurrence of the upper attenuation level.

4. The muffler system of claim 2 wherein the predetermined distance substantially corresponds to the first occurrence of the upper attenuation level exterior to the compressor shell.

5. The muffler system of claim 1 wherein the expansion muffler has an elongated chamber.

6. The muffler system of claim 1 wherein a portion of the exhaust system extends substantially vertically along the exterior of the compressor shell.

7. The muffler system of claim 6 wherein the expansion muffler is positioned adjacent to an upper portion of the compressor shell.

8. The muffler system of claim 1 wherein the resonator type muffler filters pressure pulses capable of transmitting noise to the compressor shell at its exhaust port.

9. The muffler system of claim 2 wherein the predetermined distance includes a predetermined range of distances substantially achieving the upper attenuation level of noise reduction.

10. The muffler system of claim 2 wherein the predetermined distance is about 48 inches.

11. The muffler system of claim 9 wherein the predetermined range is about 45–51 inches.

12. The muffler system of claim 9 wherein the predetermined range is about 77–82 inches.

13. A compressor system comprising:

a housing having an exhaust port;

a compression means for compressing a refrigerant fluid, the compression means being disposed within the housing, the compression means having a discharge port for exhausting compressed refrigerant fluid from the compression means;

a resonator type muffler disposed within the housing and in fluid communication with and connected to the discharge port, the resonator type muffler being in fluid communication with the exhaust port;

an expansion muffler disposed exterior to the housing a predetermined distance from the exhaust port and in fluid communication with the exhaust port, the predetermined distance of the expansion muffler being independent of the spacing along an exhaust system between the resonator type muffler and the expansion muffler.

14. The muffler system of claim 13 wherein the predetermined distance between the expansion muffler and the exhaust port substantially corresponds to an upper attenuation level of noise reduction achievable by the expansion muffler.

15. The muffler system of claim 14 wherein the predetermined distance substantially corresponds to the second occurrence of the upper attenuation level.

16. The muffler system of claim 14 wherein the predetermined distance substantially corresponds to the first occurrence of the upper attenuation level exterior to the housing.

17. The muffler system of claim 13 wherein the expansion muffler is positioned adjacent an upper portion of the housing.

18. The muffler system of claim 14 wherein the predetermined distance includes a predetermined range of distances substantially achieving the upper attenuation level of noise reduction.

19. The muffler system of claim 18 wherein the predetermined range is about 15–20 inches.

20. The muffler system of claim 18 wherein the predetermined range is about 45–50 inches.

* * * * *